US011859918B2

(12) United States Patent
Retersdorf et al.

(10) Patent No.: US 11,859,918 B2
(45) Date of Patent: Jan. 2, 2024

(54) CROSSFLOW/COUNTERFLOW SUBFREEZING PLATE FIN HEAT EXCHANGER

(71) Applicant: Hamilton Sundstrand Corporation, Charlotte, NC (US)

(72) Inventors: Alan Retersdorf, Avon, CT (US); Brian R. Shea, Windsor, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 333 days.

(21) Appl. No.: 17/215,599

(22) Filed: Mar. 29, 2021

(65) Prior Publication Data

US 2021/0333052 A1 Oct. 28, 2021

Related U.S. Application Data

(60) Provisional application No. 63/016,937, filed on Apr. 28, 2020.

(51) Int. Cl.
*F28D 9/00* (2006.01)
*F28F 3/02* (2006.01)

(52) U.S. Cl.
CPC ..... *F28D 9/0068* (2013.01); *F28D 9/0093* (2013.01); *F28F 3/025* (2013.01)

(58) Field of Classification Search
CPC ..... F28D 9/0068; F28D 9/0093; B64D 2013/0666; F28F 2250/06; F28F 3/025
See application file for complete search history.

(56) References Cited

U.S. PATENT DOCUMENTS 1,712,892 A * 5/1929 Mantle ..... F28F 3/12 165/101
4,862,952 A * 9/1989 Tarasewich ..... F28F 9/0278 165/166

(Continued)

FOREIGN PATENT DOCUMENTS

CA 2151886 A * 12/1995 ..... F28F 27/02
EP 0453080 A1 10/1991

(Continued)

OTHER PUBLICATIONS

Extended European Search Report dated Sep. 24, 2021, received for corresponding European Application No. 21170981.1, eight pages.

*Primary Examiner* — Paul Alvare
(74) *Attorney, Agent, or Firm* — Kinney & Lange, P. A.

(57) ABSTRACT

A heat exchanger includes a first end opposite a second end, a first side opposite a second side, a first layer, and a second layer. The first side and the second side extend from the first end to the second end. The first layer includes an inlet at the first end and an outlet at the second end of the heat exchanger. The second layer includes a first passage at the first end of the heat exchanger and extending from the first side to the second side and a second passage adjacent to the first passage. The second passage extends from the first side to the second side. The second layer further includes a third passage extending from the second end toward the second passage. The first passage is fluidically connected to the third passage proximate the second end and the third passage is fluidically connected to the second passage.

11 Claims, 4 Drawing Sheets

(56) References Cited

U.S. PATENT DOCUMENTS

| | | | | |
|---|---|---|---|---|
| 6,044,902 | A * | 4/2000 | Pahade | F25J 5/002 165/165 |
| 6,536,511 | B1 * | 3/2003 | Nilsson | B01D 63/08 62/93 |
| 9,745,069 | B2 | 8/2017 | Shea | |
| 10,124,452 | B2 | 11/2018 | Army et al. | |
| 10,488,117 | B1 | 11/2019 | Haugstetter | |
| 2001/0049906 | A1 * | 12/2001 | Shimazu | C01B 3/583 423/655 |
| 2003/0190513 | A1 | 10/2003 | Meissner et al. | |
| 2006/0150667 | A1 * | 7/2006 | Lee | F28F 27/02 62/507 |
| 2011/0132584 | A1 * | 6/2011 | Wilmot | F28D 1/035 165/41 |
| 2012/0031597 | A1 * | 2/2012 | Van Dijck | B01D 53/265 165/170 |
| 2012/0037347 | A1 | 2/2012 | Borghese | |
| 2014/0202663 | A1 * | 7/2014 | Shea | F28F 27/02 165/104.19 |
| 2015/0047818 | A1 * | 2/2015 | Peskos | F28D 9/0037 165/166 |
| 2017/0299287 | A1 | 10/2017 | Ribarov et al. | |
| 2017/0336149 | A1 * | 11/2017 | Ribarov | F28F 13/06 |

FOREIGN PATENT DOCUMENTS

| | | | | |
|---|---|---|---|---|
| EP | 2124010 | A2 * | 11/2009 | B01D 53/265 |
| EP | 2924385 | A1 | 9/2015 | |
| GB | 2485653 | A * | 5/2012 | F02C 7/14 |
| JP | 2016158424 | A * | 9/2016 | B01J 19/24 |

* cited by examiner

CROSSFLOW/COUNTERFLOW SUBFREEZING PLATE FIN HEAT EXCHANGER

CROSS-REFERENCE TO RELATED APPLICATION(S)

This application claims priority to provisional application No. 63/016,937 filed on Apr. 28, 2020.

BACKGROUND

The present disclosure relates to heat exchangers, and in particular, to plate-fin heat exchangers.

Heat exchangers are often used to transfer heat between two fluids. For example, in aircraft environmental control systems, heat exchangers may be used to transfer heat between a relatively hot air source (e.g., bleed air from a gas turbine engine) and a relatively cool air source (e.g., ram air). Some heat exchangers, often referred to as plate-fin heat exchangers, include a plate-fin core having multiple heat transfer sheets arranged in layers to define air passages there between. Closure bars seal alternating inlets of hot air and cool air inlet sides of the core. Accordingly, hot air and cool air are directed through alternating passages to form alternating layers of hot and cool air within the core. Heat is transferred between the hot and cool air via the heat transfer sheets that separate the layers. In addition, to facilitate heat transfer between the layers, each of the passages can include heat transfer fins, often formed of a material with high thermal conductivity (e.g., aluminum), that are oriented in the direction of the flow within the passage. The heat transfer fins increase turbulence and a surface area that is exposed to the airflow, thereby enhancing heat transfer between the layers.

In some applications, heat exchangers can be exposed to extremely cold temperatures. When a heat exchanger is exposed to extremely cold temperatures ice accretion can occur. When there is ice accretion on a heat exchanger the ice accretion can result in restricting airflow into or out of the heat exchanger.

SUMMARY

In one aspect of the disclosure, a heat exchanger includes a first end opposite a second end and a first side opposite a second side. The first side and the second side extend from the first end to the second end. The heat exchanger further includes a first layer and a second layer. The first layer includes an inlet at the first end of the heat exchanger and an outlet at the second end of the heat exchanger. The second layer includes a first passage at the first end of the heat exchanger. The first passage extends from the first side to the second side. The second layer further includes a second passage adjacent to the first passage. The second passage extends from the first side to the second side. The second layer further includes a third passage extending from the second end toward the second passage. The first passage is fluidically connected to the third passage proximate the second end and the third passage is fluidically connected to the second passage.

In another aspect of the disclosure, a heat exchanger includes a first end opposite a second end, a first side opposite a second side, a first layer, and a second layer. The first side and the second side extend from the first end to the second end. The first layer includes an inlet at the first end of the heat exchanger and an outlet at the second end of the heat exchanger. The second layer includes a first passage at the first end of the heat exchanger. The first passage extends from the first side to the second side. The second layer further includes a second passage adjacent to the first passage. The second passage extends from the first side to the second side. The second layer further includes a third passage extending from the second end toward the second passage. The third passage is fluidically connected between the first passage and the second passage.

In another aspect of the disclosure, a method for guiding a hot flow and a cold flow through a heat exchanger. The method includes directing the cold flow through an inlet of a cold layer at a first end of the heat exchanger and out an outlet at a second end of the heat exchanger opposite the first end. The method further includes directing the hot flow through an inlet of a hot layer and into a melt pass passage of the hot layer at the first end. The melt pass passage extends from a first side of the heat exchanger to a second side of the heat exchanger. The first side and the second side both extend from the first end to the second end of the heat exchanger. The method further includes directing the hot flow out of the melt pass passage, to the second end, and into a counterflow passage. The counterflow passage extends from the second end toward the first end between the first side and the second side of the heat exchanger. The method further includes directing the hot flow from the second end toward the first end in the counterflow passage and directing the hot flow out of the counterflow passage and into a last pass passage. The last pass passage is between the melt pass passage and the counterflow passage and extends from the second side to the first side.

DETAILED DESCRIPTION

The present disclosure relates to a plate-fin heat exchanger. The plate-fin heat exchanger includes a first layer and a second layer. The first layer is configured for cold airflow while the second layer is configured for hot airflow. The second layer is further configured to direct hot air above or below the inlet for the first layer. The hot air above or below the inlet for the first layer helps prevent ice accretion on the inlet side of the first layer. The plate fin heat exchanger will be described below with reference to FIGS. 1-4.

Figure 1:
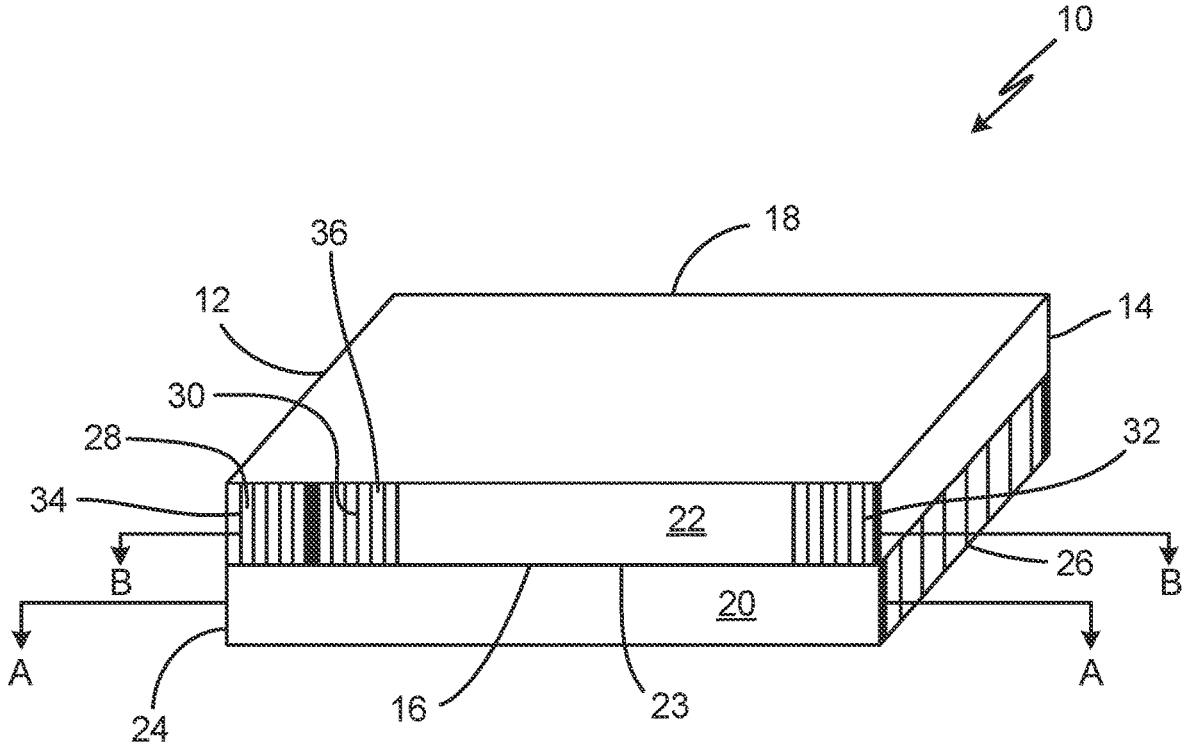
FIG. 1 is a perspective view of a heat exchanger.

FIG. 1 is a perspective view of heat exchanger 10. Heat exchanger 10 includes first end 12, second end 14, first side 16, second side 18, first layer 20, second layer 22, and parting sheet 23. First layer 20 includes inlet 24 and outlet 26. Second layer 22 includes melt flow passage or first passage 28, last pass passage or second passage 30, counterflow passage or third passage 32, inlet 34, and outlet 36. Parting sheet 23 separates first layer 20 from second layer 22 and enables heat transfer therebetween. Inlet 24 of first layer 20 is at first end 12 and extends from first side 16 to second side 18. Outlet 26 of first layer 20 is at second end 14 and extends from first side 16 to second side 18. First passage 28 of second layer 22 is at first end 12 and extends from first side 16 to second side 18. Inlet 34 of second layer 22 is at first side 16 of first passage 28. Second passage 30 of second layer 22 is adjacent to first passage 28 of second layer 22 and extends from first side 16 to second side 18. Outlet 36 of second layer 22 is at first side 16 of second passage 30. Third passage 32 of second layer 22 extends from second end 14 toward second passage 30. First passage 28 is fluidically connected to third passage 32 proximate second end 14. Third passage 32 is fluidically connected to second passage 30 such that third passage 32 is fluidically connected in series between first passage 28 and second passage 30.

In the aspect of the disclosure shown in FIG. 1 there are only two layers, first layer 20 and second layer 22. In other aspects of the disclosure, heat exchanger 10 can include multiple layers alternating between first layer 20 and second layer 22 with parting sheet 23 between each layer. Heat exchanger 10 can be made from aluminum, stainless steel, titanium, or any other material suitable for heat exchangers.

Figure 2:
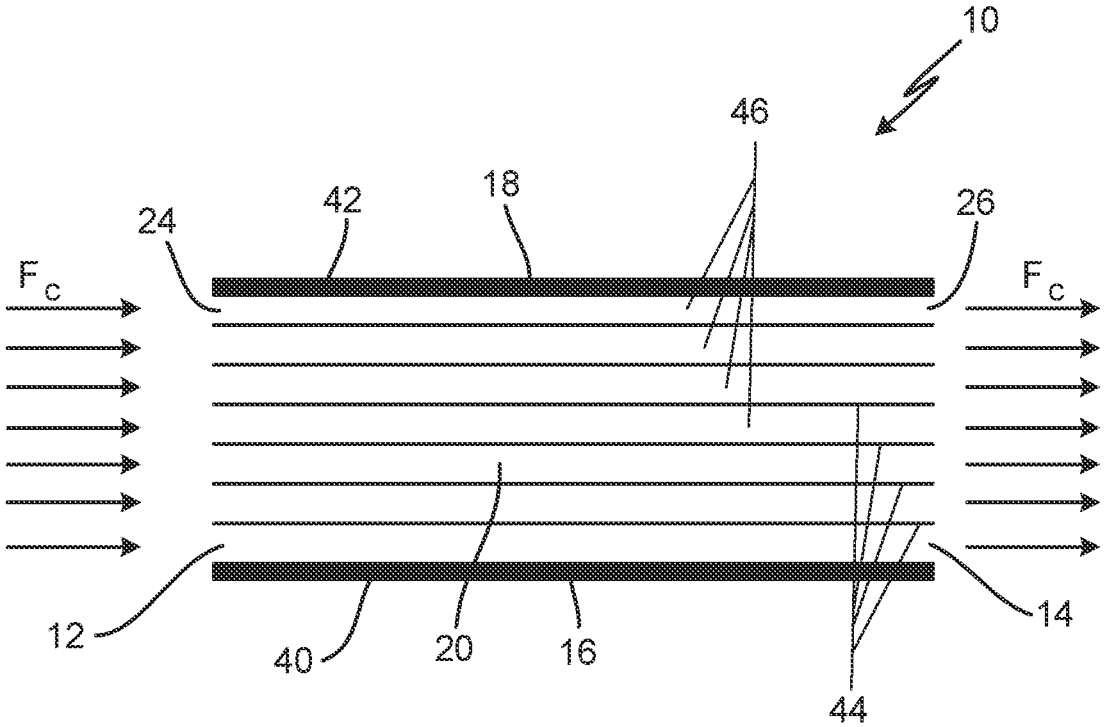
FIG. 2 is a cross-sectional view of the heat exchanger taken along line A-A in FIG. 1, showing a first layer of the heat exchanger.

FIG. 2 is a cross-sectional view of heat exchanger 10 taken along line A-A in FIG. 1, showing first layer 20 of heat exchanger 10. First layer 20 includes first closure bar 40, second closure bar 42, plurality of fins 44, plurality of passages 46 and cold flow $F_C$. First closure bar 40 is on first side 16 and extends from first end 12 to second end 14. Second closure bar 42 is on second side 18 and extends from first end 12 to second end 14. Plurality of fins 44 are between first closure bar 40 and second closure bar 42 and extends from first end 12 to second end 14. Plurality of fins 44 define plurality of passages 46 extending from first end 12 to second end 14.

In operation, cold flow $F_C$ enters heat exchanger 10 at inlet 24 of first layer 20. Cold flow $F_C$ flows through plurality of passages 46 from first end 12 to second end 14. Then cold flow $F_C$ flows out of heat exchanger 10 through outlet 26 of first layer 20. As cold flow $F_C$ flows through plurality of passages 46 in first layer 20, cold flow $F_C$ absorbs heat from plurality of fins 44 and first closure bar 40 and second closure bar 42.

Figure 3:
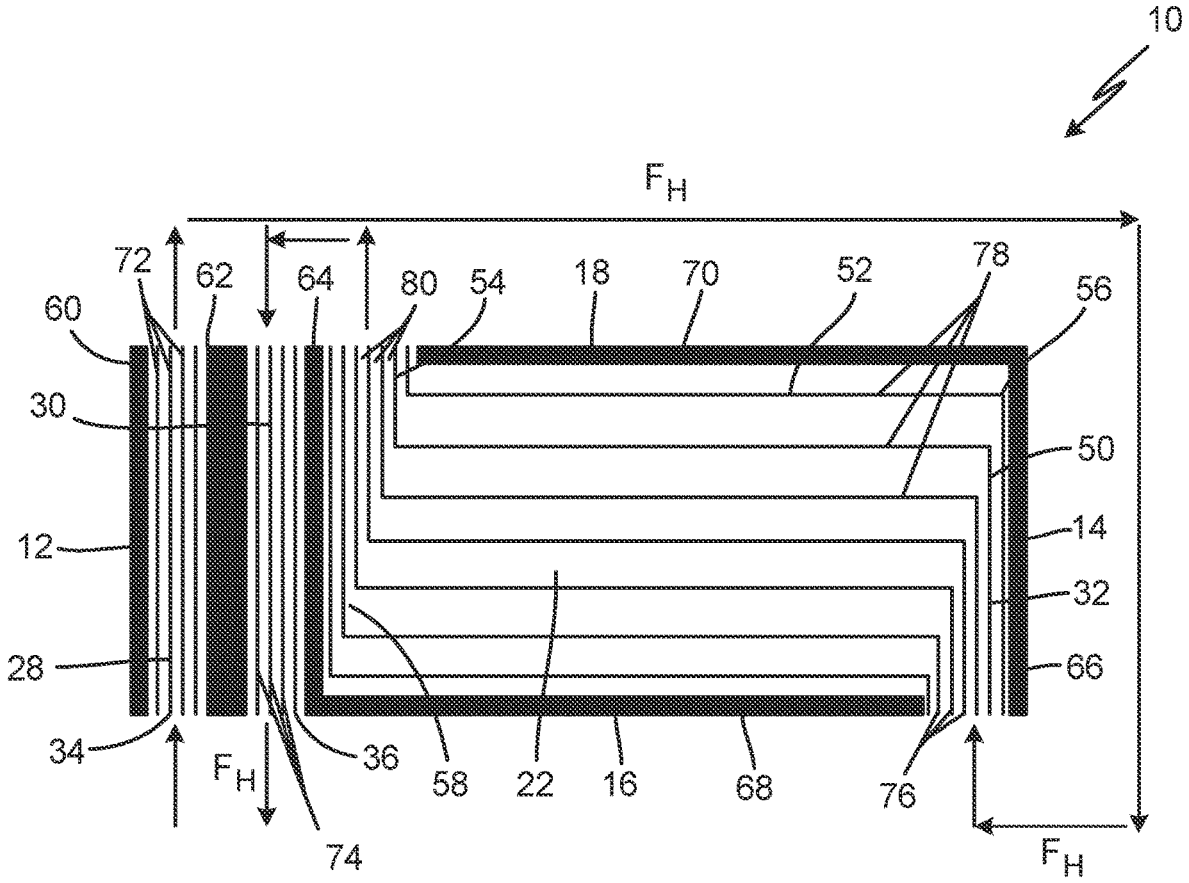
FIG. 3 is a cross-sectional view of the heat exchanger taken along line B-B in FIG. 1, showing a second layer of the heat exchanger.

FIG. 3 is a cross-sectional view of heat exchanger 10 taken along line B-B in FIG. 1, showing second layer 22 of heat exchanger 10. As discussed in reference to FIG. 1 above, second layer 22 includes first passage 28, second passage 30, and third passage 32. Third passage 32 includes first portion 50, second portion 52, third portion 54, first turn 56, and second turn 58. Second layer 22 also includes first closure bar 60, second closure bar 62, third closure bar 64, fourth closure bar 66, fifth closure bar 68, and sixth closure bar 70. Second layer 22 also includes first plurality of fins 72, second plurality of fins 74, third plurality of fins 76, fourth plurality of fins 78, fifth plurality of fins 80, and hot flow $F_H$.

As shown in FIG. 3, first passage 28 is upstream to first portion 50 of third passage 32, and third portion 54 of third passage 32 is fluidically upstream to second passage 30. First portion 50 of third passage 32 extends from first side 16 to second side 18. Second portion 52 of third passage 32 extends from first portion 50 toward first end 12. Third portion 54 of third passage 32 is between second passage 30 and second portion 52 and extends from first side 16 to second side 18. First turn 56 is between first portion 50 and second portion 52. Second turn 58 is between second portion 52 and third portion 54.

First closure bar 60 is on first end 12 and extends from first side 16 to second side 18. Second closure bar 62 is between first passage 28 and second passage 30 and extends from first side 16 to second side 18 and separates first passage 28 and second passage 30. Third closure bar 64 is between second passage 30 and third portion 54 of third passage 32 and extends from first side 16 to second side 18. Third closure bar 64 separates second passage 30 and third portion 54 of third passage 32. Fourth closure bar 66 is on second end 14 and extends from first side 16 to second side 18. Fifth closure bar 68 is on first side 16 and extends from third closure bar 64 toward fourth closure bar 66. Sixth closure bar 70 is on second side 18 and extends from fourth closure bar 66 toward third closure bar 64. Fifth closure bar 68 and sixth closure bar 70 form the sides of second portion 52 of third passage 32. In the aspect of the disclosure depicted in FIG. 3, second closure bar 62 has a thickness equal to two closure bars. The extra thickness of second closure bar 62 improves the insulation between first passage 28 and second passage 30. The insulation between first passage 28 and second passage 30 attenuates the heat transfer between hot air flow $F_H$ in first passage 28 and hot air flow $F_H$ in second passage 30. The attenuated heat transfer between hot air flow $F_H$ in first passage 28 and hot air flow $F_H$ in second passage 30 helps control the temperature of hot air flow $F_H$ throughout second layer 22. Controlling the of hot air flow $F_H$ through attenuating heat transfer between hot air flow $F_H$ in first passage 28 and hot air flow $F_H$ in second passage 30 the likelihood of damage (e.g., warping or twisting) to second layer 22 from exposure to extremely high temperatures.

First plurality of fins 72 is in first passage 28 and extends in a direction parallel to second closure bar 62 and extend from first side 16 to second side 18. Second plurality of fins 74 is in second passage 30 and extends in a direction parallel to second closure bar 62 and extends from first side 16 to second side 18. Third plurality of fins 76 is in first portion 50 of third passage 32 and extends in a direction parallel to fourth closure bar 66. Fourth plurality of fins 78 is in the second portion 52 of third passage 32 and extends in a direction parallel to fifth closure bar 68 and sixth closure bar 70. Fifth plurality of fins 80 is in third portion 54 of third passage 32 and extends in a direction parallel to third closure bar 64.

In operation, hot flow $F_H$ enters heat exchanger 10 through inlet 34 of second layer 22 and first plurality of fins 72 guides hot flow $F_H$ through first passage 28. Hot flow $F_H$ travels in first passage 28 from first side 16 to second side 18. As hot flow $F_H$ travels in first passage 28, heat is transferred from hot flow $F_H$ into first plurality of fins 72 and parting sheet 23 to warm inlet 24 of first layer 20 and prevent ice accumulation at inlet 24 of first layer 20. Hot flow $F_H$ flows out of first passage 28 at second side 18 and is routed into first section 50 of third passage 32 at second end 14 of heat exchanger 10. An insulated manifold, tube, or passage, neither of which are shown in FIG. 3, can connect first passage 28 to third passage 32. In third passage 32, third plurality of fins 76 directs hot flow $F_H$ through first section 50 of third passage 32. Hot flow $F_H$ turns at first turn 56 and fourth plurality of fins 78 directs hot flow $F_H$ through second section 52 of third passage 32. As hot flow $F_H$ travels in second section 52, hot flow $F_H$ travels away from second end 14 and toward first end 12 in a direction that is counter to the flow direction of cold flow $F_C$ in first layer 20. Hot flow $F_H$ turns toward second side 18 at second turn 58 and fifth plurality of fins 80 directs hot flow $F_H$ through third section 54 of third passage 32 toward second side 18. Hot flow $F_H$ is then guided into second passage 30. Hot flow $F_H$ can be guided from third section 54 of third passage 32 into second passage 64 by a turning manifold or tube (not shown) connected to second side 18. Second plurality of fins 74 directs hot flow $F_H$ through second passage 30. Hot flow $F_H$ travels in second passage 30 from second side 18 toward first side 16. Lastly, hot flow $F_H$ exits second passage 30 at outlet 36 on first side 16. Because hot flow $F_H$ enters second layer 22 at first end 12, then travels from second end 14 toward first end 12 and exits between first end 12 and second end 14, first end 12 and second end 14 are warmer than outlet 36 of second layer 22. Thus, if the temperature at outlet 36 of second layer 22 is controlled above freezing, the rest of heat exchanger 10 will be above freezing and prevent ice formation and accumulation throughout heat exchanger 10.

Figure 4:
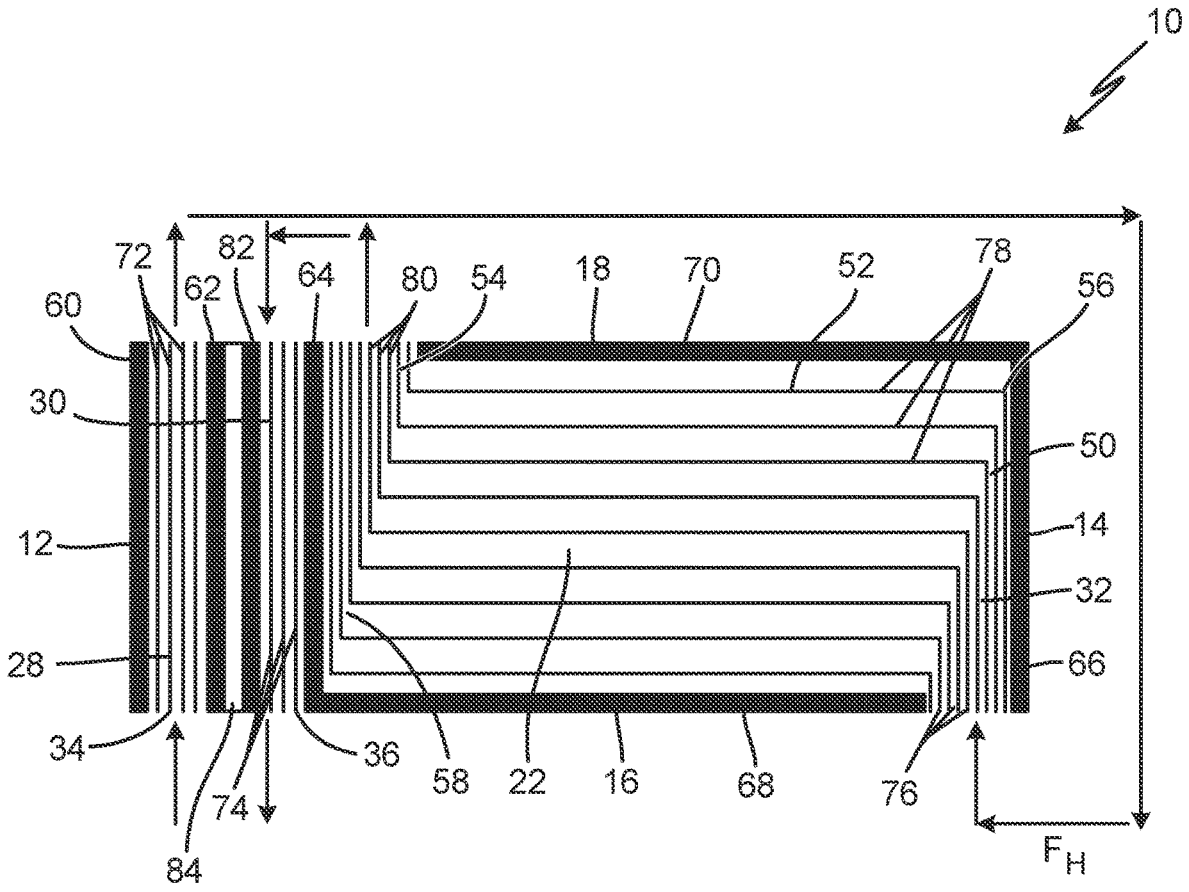
FIG. 4 is a cross-sectional view of another embodiment of the heat exchanger, showing a second layer of the heat exchanger.

FIG. 4 is a cross-sectional view of another embodiment of heat exchanger 10 taken, showing second layer 22 of heat exchanger 10. Second layer 22 of heat exchanger 10, as depicted in FIG. 4, includes all elements of heat exchanger 10 as shown in FIG. 3, and is configured and functions similarly to heat exchanger 10 of FIG. 3 with the addition of seventh closure bar 82 and insulation zone 84.

As shown in FIG. 4, seventh closure bar 82 is between second closure bar 62 and second passage 30 and extends from first side 16 to second side 18. Insulation zone 84 is defined by a space between second closure bar 62 and seventh closure bar 82 extending from first side 16 to second side 18. Insulation zone 84 provides insulation between first passage 28 and second passage 30. Insulation zone 84 decreases the heat transfer between hot air flow $F_H$ in first passage 28 and hot air flow $F_H$ in second passage 30. The insulation between first passage 28 and second passage 30 attenuates the heat transfer between hot air flow $F_H$ in first passage 28 and hot air flow $F_H$ in second passage 30. The attenuated heat transfer between hot air flow $F_H$ in first passage 28 and hot air flow $F_H$ in second passage 30 helps control the temperature of hot air flow $F_H$ throughout second layer 22. Controlling the of hot air flow $F_H$ through attenuating heat transfer between hot air flow $F_H$ in first passage 28 and hot air flow $F_H$ in second passage 30 the likelihood of damage (e.g., warping or twisting) to second layer 22 from exposure to extremely high temperatures.

In the aspects of the disclosure as shown in FIGS. 1, 3, and 4 second layer 22 includes melt pass passage or first passage 28, last pass passage or second passage 30, and counterflow passage or third passage 22. Each of first passage 28, second passage 30, and third passage 32 will be described further in the following paragraphs.

As discussed above in paragraphs [0020] and [0022] hot flow $F_H$ enters second layer 22 of heat exchanger 10 at inlet 34 of first passage 28. As hot flow $F_H$ enters second layer 22 of heat exchanger 10 at inlet 34, hot flow $F_H$ is the hottest air in heat exchanger 10. Therefore, the location of first passage 28, on first end 12 extending from first side 16 to second side 18 helps prevent ice accretion on the structure surrounding inlet 24 of first layer 20. Eliminating ice accretion on the structure surrounding inlet 24 of first layer 20 mitigates undesirable restrictions to both cold flow $F_C$ and hot flow $F_H$ throughout heat exchanger 10.

The location of last pass passage or second passage 30 is important as the location of second passage 30 enables first passage 28 to be proximate first end 12 to aid in preventing ice accretion on the structure surrounding inlet 24 of first layer 20. Furthermore, the location of second passage 30 enables an increased surface area for third passage 32 to encourage heat transfer between first layer 20 and second layer 22.

Counterflow passage or third passage 32 improves the heat transfer between cold flow $F_C$ in first layer 20 and hot flow $F_H$ in second layer 22 through parting sheet 37. Directing hot flow $F_H$ through third passage 32, in a direction opposite to the cold flow $F_C$ in first layer 20, improves the heat transfer between cold flow $F_C$ in first layer 20 and hot flow $F_H$ in second layer 22. Furthermore, the configuration of third passage 32 decreases the pressure drop through heat exchanger 10 as third passage 32 is wider than first passage 28 and third passage 32 and contains fewer turns than traditional heat exchangers.

DISCUSSION OF POSSIBLE EMBODIMENTS

The following are non-exclusive descriptions of possible embodiments of the present invention.

In one aspect of the disclosure, a heat exchanger includes a first end opposite a second end and a first side opposite a second side. The first side and the second side extend from the first end to the second end. The heat exchanger further includes a first layer and a second layer. The first layer includes an inlet at the first end of the heat exchanger and an outlet at the second end of the heat exchanger. The second layer includes a first passage at the first end of the heat exchanger. The first passage extends from the first side to the second side. The second layer further includes a second passage adjacent to the first passage. The second passage extends from the first side to the second side. The second layer further includes a third passage extending from the second end toward the second passage. The first passage is fluidically connected to the third passage proximate the second end and the third passage is fluidically connected to the second passage.

The heat exchanger of the preceding paragraph can optionally include, additionally and/or alternatively, any one or more of the following features, configurations and/or additional components:

- wherein the third passage includes: a first portion extending from the first side to the second side; a second portion extending from the first portion toward the first end; a third portion between the second passage and the second portion, wherein the third portion extends from the first side to the second side; a first turn between the first portion and the second portion; and a second turn between the second portion and the third portion, wherein the first passage is fluidically upstream to the first portion of the third passage, and wherein the third portion of the third passage is fluidically upstream with the second passage;
- wherein the second layer further comprises: an inlet of the second layer formed on the first passage at the first side; and an outlet of the second layer formed on the second passage at the first side;
- wherein the first layer further comprises: a first closure bar extending from the first end to the second end on the first side; a second closure bar extending from the first end to the second end on the second side; and a plurality of fins extending from the first end to the second end between the first closure bar and the second closure bar and defining a plurality of passageways;
- wherein the second layer further includes: a first closure bar at the first end and extending from the first side to the second side; a second closure bar extending from the first side to the second side between the first passage and the second passage; a third closure bar extending from the first side to the second side between the second passage and the third portion of the third passage; a fourth closure bar at the second end and extending from the first side to the second side; a fifth closure bar extending from the third closure bar toward the fourth closure bar on the first side; and a sixth closure bar extending from the fourth closure bar toward the third closure bar on the second side;

wherein the second layer further includes: a first plurality of fins in the first passage extending in a direction parallel to the second closure bar; a second plurality of fins in the second passage and extending in the direction parallel to the second closure bar; a third plurality of fins in the first portion of the third passage and extending in a direction parallel to the fourth closure bar; a fourth plurality of fins in the second portion of the third passage and extending in a direction parallel to the fifth closure bar and the sixth closure bar; and a fifth plurality of fins in the third portion of the third passage and extending in a direction parallel to the third closure bar;

wherein the first layer is a cold layer; and/or wherein the second layer is a hot layer.

In another aspect of the disclosure, a heat exchanger includes a first end opposite a second end, a first side opposite a second side, a first layer, and a second layer. The first side and the second side extend from the first end to the second end. The first layer includes an inlet at the first end of the heat exchanger and an outlet at the second end of the heat exchanger. The second layer includes a first passage at the first end of the heat exchanger. The first passage extends from the first side to the second side. The second layer further includes a second passage adjacent to the first passage. The second passage extends from the first side to the second side. The second layer further includes a third passage extending from the second end toward the second passage. The third passage is fluidically connected between the first passage and the second passage.

The heat exchanger of the preceding paragraph can optionally include, additionally and/or alternatively, any one or more of the following features, configurations and/or additional components:

wherein the third passage includes: a first portion extending from the first side to the second side; a second portion extending from the first portion toward the first end; a third portion between the second passage and the second portion, wherein the third portion extends from the first side to the second side; a first turn between the first portion and the second portion; and a second turn between the second portion and the third portion, wherein the first passage is fluidically upstream to the first portion of the third passage, and wherein the third portion of the third passage is fluidically upstream to the second passage;

wherein the second layer further includes: an inlet of the second layer formed on the first passage of the first side; and an outlet of the second layer formed on the second passage at the first side;

wherein the first layer further includes: a first closure bar extending from the first end to the second end on the first side; a second closure bar extending from the first end to the second end on the second side; and a plurality of fins extending from the first end to the second end between the first closure bar and the second closure bar and defining a plurality of passageways;

wherein the second layer further includes: a first closure bar at the first end and extending from the first side to the second side; a second closure bar extending from the first side to the second side between the first passage and the second passage; a third closure bar extending from the first side to the second side between the second passage and the third portion of the third passage; a fourth closure bar at the second end and extending from the first side to the second side; a fifth closure bar extending from the third closure bar toward the fourth closure bar on the first side; and a sixth closure bar extending from the fourth closure bar toward the third closure bar on the second side;

wherein the second layer further includes: a first plurality of fins in the first passage extending in a direction parallel to the second closure bar; a second plurality of fins in the second passage and extending in the direction parallel to the second closure bar; a third plurality of fins in the first portion of the third passage and extending in a direction parallel to the fourth closure bar; a fourth plurality of fins in the second portion of the third passage and extending in a direction parallel to the fifth closure bar and sixth closure bar; and a fifth plurality of fins in the third portion of the third passage and extending in a direction parallel to the third closure bar; and/or wherein the second layer further includes: a seventh closure bar, extending from the first side to the second side between the second closure bar and the second passage, wherein the seventh closure bar is spaced from the second closure bar in a direction perpendicular to the second closure bar, and wherein a space between the seventh closure bar and the second closure bar defines an insulation zone.

In another aspect of the disclosure, a method for guiding a hot flow and a cold flow through a heat exchanger. The method includes directing the cold flow through an inlet of a cold layer at a first end of the heat exchanger and out an outlet at a second end of the heat exchanger opposite the first end. The method further includes directing the hot flow through an inlet of a hot layer and into a melt pass passage of the hot layer at the first end. The melt pass passage extends from a first side of the heat exchanger to a second side of the heat exchanger. The first side and the second side both extend from the first end to the second end of the heat exchanger. The method further includes directing the hot flow out of the melt pass passage, to the second end, and into a counterflow passage. The counterflow passage extends from the second end toward the first end between the first side and the second side of the heat exchanger. The method further includes directing the hot flow from the second end toward the first end in the counterflow passage and directing the hot flow out of the counterflow passage and into a last pass passage. The last pass passage is between the melt pass passage and the counterflow passage and extends from the second side to the first side.

The method of the preceding paragraph can optionally include, additionally and/or alternatively, any one or more of the following features, configurations and/or additional components:

the method further including: directing the hot flow out of the heat exchanger through an outlet of the hot layer connected to the last pass passage at the first side of the heat exchanger;

the method further including: turning the hot flow at the second side between the counterflow passage and the last pass passage;

wherein the hot flow is directed in a direction parallel to the first side and the second side in a majority of a length of the counterflow passage; and/or wherein the melt pass passage directs the hot flow over or under the inlet of the cold layer.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger comprising:
a first end opposite a second end;
a first side opposite a second side, wherein the first side and the second side extend from the first end to the second end;
a first layer comprising:
an inlet at the first end of the heat exchanger; and
an outlet at the second end of the heat exchanger; and
a second layer comprising:
a first passage at the first end of the heat exchanger and extending from the first side to the second side;
a second passage adjacent to the first passage, wherein the second passage extends from the first side to the second side and wherein the second layer further comprises:
a first closure bar at the first end and extending from the first side to the second side;
a second closure bar extending from the first side to the second side between the first passage and the second passage;
a third closure bar extending from the first side to the second side between the second passage and the third portion of the third passage;
a fourth closure bar at the second end and extending from the first side to the second side;
a fifth closure bar extending from the third closure bar toward the fourth closure bar on the first side;
a sixth closure bar extending from the fourth closure bar toward the third closure bar on the second side;
a first plurality of fins in the first passage extending in a direction parallel to the second closure bar;
a second plurality of fins in the second passage and extending in the direction parallel to the second closure bar;
a third plurality of fins in the first portion of the third passage and extending in a direction parallel to the fourth closure bar;
a fourth plurality of fins in the second portion of the third passage and extending in a direction parallel to the fifth closure bar and the sixth closure bar; and
a fifth plurality of fins in the third portion of the third passage and extending in a direction parallel to the third closure bar; and
a third passage extending from the second end toward the second passage, wherein the first passage is fluidically connected to the third passage proximate the second end, and wherein the third passage is fluidically connected to the second passage, wherein the third passage comprises:
a first portion extending from the first side to the second side;
a second portion extending from the first portion toward the first end;
a third portion between the second passage and the second portion, wherein the third portion extends from the first side to the second side;
a first turn between the first portion and the second portion; and
a second turn between the second portion and the third portion,
wherein the first passage is fluidically upstream to the first portion of the third passage, and
wherein the third portion of the third passage is fluidically upstream with the second passage.

2. The heat exchanger of claim 1, wherein the second layer further comprises:
an inlet of the second layer formed on the first passage at the first side; and
an outlet of the second layer formed on the second passage at the first side.

3. The heat exchanger of claim 1, wherein the first layer further comprises:
a first closure bar extending from the first end to the second end on the first side;
a second closure bar extending from the first end to the second end on the second side; and
a plurality of fins extending from the first end to the second end between the first closure bar and the second closure bar and defining a plurality of passageways.

4. The heat exchanger of claim 1, wherein the first layer is a cold layer.

5. The heat exchanger of claim 1, wherein the second layer is a hot layer.

6. A heat exchanger comprising:
a first end opposite a second end;
a first side opposite a second side, wherein the first side and the second side extend from the first end to the second end;
a first layer comprising:
an inlet at the first end of the heat exchanger; and
an outlet at the second end of the heat exchanger; and
a second layer comprising:
a first passage at the first end of the heat exchanger and extending from the first side to the second side;
a second passage adjacent to the first passage, wherein the second passage extends from the first side to the second side and wherein the second layer further comprises:
a first closure bar at the first end and extending from the first side to the second side;
a second closure bar extending from the first side to the second side between the first passage and the second passage;
a third closure bar extending from the first side to the second side between the second passage and the third portion of the third passage;
a fourth closure bar at the second end and extending from the first side to the second side;
a fifth closure bar extending from the third closure bar toward the fourth closure bar on the first side;
a sixth closure bar extending from the fourth closure bar toward the third closure bar on the second side;
a first plurality of fins in the first passage extending in a direction parallel to the second closure bar;
a second plurality of fins in the second passage and extending in the direction parallel to the second closure bar;

a third plurality of fins in the first portion of the third passage and extending in a direction parallel to the fourth closure bar;

a fourth plurality of fins in the second portion of the third passage and extending in a direction parallel to the fifth closure bar and the sixth closure bar; and a fifth plurality of fins in the third portion of the third passage and extending in a direction parallel to the third closure bar; and a third passage extending from the second end toward the second passage, wherein the third passage is fluidically connected between the first passage and the second passage, wherein the third passage comprises:

a first portion extending from the first side to the second side;

a second portion extending from the first portion toward the first end;

a third portion between the second passage and the second portion, wherein the third portion extends from the first side to the second side;

a first turn between the first portion and the second portion; and a second turn between the second portion and the third portion, wherein the first passage is fluidically upstream to the first portion of the third passage, and wherein the third portion of the third passage is fluidically upstream to the second passage.

7. The heat exchanger of claim 6, wherein the second layer further comprises:

an inlet of the second layer formed on the first passage of the first side; and an outlet of the second layer formed on the second passage at the first side.

8. The heat exchanger of claim 6, wherein the first layer further comprises:

a first closure bar extending from the first end to the second end on the first side;

a second closure bar extending from the first end to the second end on the second side; and a plurality of fins extending from the first end to the second end between the first closure bar and the second closure bar and defining a plurality of passageways.

9. A heat exchanger comprising:

a first end opposite a second end;

a first side opposite a second side, wherein the first side and the second side extend from the first end to the second end;

a first layer comprising:

an inlet at the first end of the heat exchanger; and an outlet at the second end of the heat exchanger; and a second layer comprising:

a first passage at the first end of the heat exchanger and extending from the first side to the second side;

a second passage adjacent to the first passage, wherein the second passage extends from the first side to the second side and wherein the second layer further comprises:

a first closure bar at the first end and extending from the first side to the second side;

a second closure bar extending from the first side to the second side between the first passage and the second passage;

a third closure bar extending from the first side to the second side between the second passage and the third portion of the third passage;

a fourth closure bar at the second end and extending from the first side to the second side;

a fifth closure bar extending from the third closure bar toward the fourth closure bar on the first side;

a sixth closure bar extending from the fourth closure bar toward the third closure bar on the second side; and a seventh closure bar, extending from the first side to the second side between the second closure bar and the second passage, wherein the seventh closure bar is spaced from the second closure bar in a direction perpendicular to the second closure bar, and wherein a space between the seventh closure bar and the second closure bar defines an insulation zone; and a third passage extending from the second end toward the second passage, wherein the third passage is fluidically connected between the first passage and the second passage, wherein the third passage comprises:

a first portion extending from the first side to the second side;

a second portion extending from the first portion toward the first end;

a third portion between the second passage and the second portion, wherein the third portion extends from the first side to the second side;

a first turn between the first portion and the second portion; and a second turn between the second portion and the third portion, wherein the first passage is fluidically upstream to the first portion of the third passage, and wherein the third portion of the third passage is fluidically upstream to the second passage.

10. The heat exchanger of claim 9, wherein the second layer further comprises:

an inlet of the second layer formed on the first passage of the first side; and an outlet of the second layer formed on the second passage at the first side.

11. The heat exchanger of claim 9, wherein the first layer further comprises:

a first closure bar extending from the first end to the second end on the first side;

a second closure bar extending from the first end to the second end on the second side; and a plurality of fins extending from the first end to the second end between the first closure bar and the second closure bar and defining a plurality of passageways.

* * * * *